United States Patent [19]

Lequeux et al.

[11] 4,203,474

[45] May 20, 1980

[54] DEVICE FOR MECHANICALLY PROTECTING THE ANNULAR EDGE OF A TUBE

[76] Inventors: Christian Lequeux, 94, Avenue de Strasbourg, 57000 Metz; Henri Chapuis, 14, Allée de la Liberation, 57100 Thionville, both of France

[21] Appl. No.: 867,443

[22] Filed: Jan. 6, 1978

[30] Foreign Application Priority Data

Jan. 7, 1977 [FR] France ..... 77 00354

[51] Int. Cl.[2] ..... B65D 59/00; B65D 59/06

[52] U.S. Cl. ..... 138/96 R; 138/96 T

[58] Field of Search ..... 138/96 R, 96 T

[56] References Cited

U.S. PATENT DOCUMENTS

| | | | |
|---|---|---|---|
| 1,771,522 | 7/1930 | Berge | 138/96 T |
| 1,853,944 | 4/1932 | Unke | 138/96 T |
| 2,044,568 | 6/1936 | Gunderman | 138/96 T |
| 2,156,221 | 4/1939 | Kahn et al. | 138/96 T |
| 2,167,235 | 7/1939 | Engstrom | 138/96 T |
| 2,196,454 | 4/1940 | Kahn et al. | 138/96 T |
| 2,238,642 | 4/1941 | Hicks | 138/96 T |
| 2,238,643 | 4/1941 | Hicks | 138/96 T |
| 3,370,615 | 2/1968 | Tamaki et al. | 138/96 R |
| 3,911,960 | 10/1975 | Flimon | 138/96 R |

FOREIGN PATENT DOCUMENTS

| | | | |
|---|---|---|---|
| 2343836 | 6/1973 | Fed. Rep. of Germany | 138/96 R |
| 2336197 | 2/1974 | Fed. Rep. of Germany | 138/96 T |

*Primary Examiner*—Henry K. Artis

*Attorney, Agent, or Firm*—Cushman, Darby & Cushman

[57] ABSTRACT

The invention relates to a ferrule inserted in a tube end in view of protecting from impacts the annular edge of said end, said ferrule 4 being extended by a radially outwardly turned back flange 5 covering said edge. Said flange is itself extended from its periphery 7 by a second flange 6 turned back in the same direction as the first flange so as to extend towards the axis of the ferrule.

8 Claims, 3 Drawing Figures

DEVICE FOR MECHANICALLY PROTECTING THE ANNULAR EDGE OF A TUBE

Figure 1:
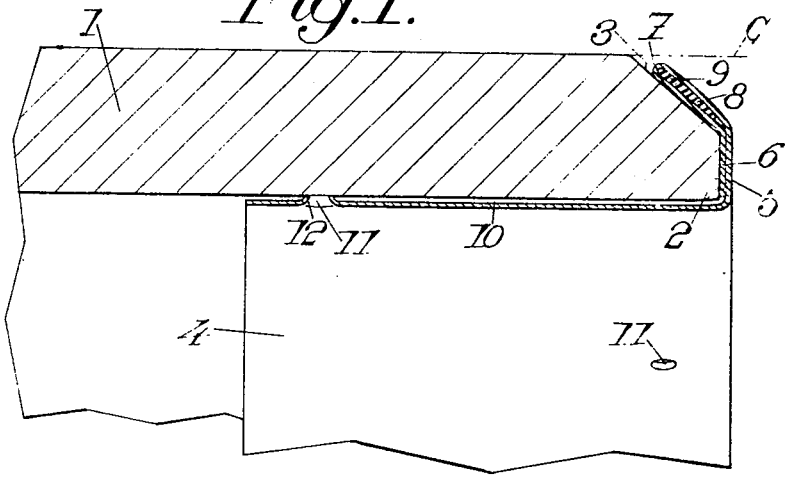

The invention relates to devices for mechanically protecting from impacts the annular edges of tubes or tubular end-pieces precision machined with a view to their subsequent assembly with other annular surfaces.

It concerns more particularly, among these devices, those for protecting the annular edges, generally chamfered, of smooth tubes having a relatively large diameter, such a diameter being generally greater than 20 cm and reaching 2 meters or even more, these edges being intended for assembly, generally by welding, against similar edges, disposed axially opposite, of similar tubes with a view to forming transport pipes for fluids (oil, water, gas . . . ).

It is recalled that, to ensure such a protection, it has already been proposed to use cylindrical shells having a relatively great thickness (3 to 5 mm) adapted to be jointingly introduced into the ends of tubes to be protected and extended radially outwards by collars disposed against the annular edges to be protected.

The impacts received by such shells are not correctly damped and cause cold-drawing of the metal forming said edges.

Moreover, said shells are expensive, heavy and their fitting on the ends of the tubes to be protected leaves much to be desired, not only in so far as the lack of solidity is concerned but also the lack of ventilation of the gaps between these shells and the tubular surfaces opposite: this latter disadvantage can lead, on the one hand, to local molecular adhesion of the shells against the tubes, which makes their separation difficult and, on the other hand, to undesirable retention of humidity in said gaps, which can create troublesome oxidation.

The invention has as its aim especially, to remedy some at least of these different disadvantages.

The protection devices of the invention comprise again a metal ferrule extended by a radially outwardly turned back flange adapted to cover the edge to be protected and they are essentially characterised in that this turned back flange or flap is itself extended from its periphery by a second flange folded back in the same direction as the first flap so as to extend radially towards the axis of the ferrule, axially on the same side as the body of this ferrule in relation to the first flap.

In preferred embodiments, recourse is had furthermore to one and/or the other of the following arrangements:

the outer diameter of the mutual annular connection zone of the two flaps is less than the outer diameter of the end of the tube to be protected, the thickness of the tube end to be protected is greater than 1 cm and the thickness of the ferrule is of the order of a millimeter or generally between 0.5 and 2.5 mm, a shock absorbing element is inserted axially between the two flaps, such as an asbestos or elastomer joint, perforations are provided in the ferrule radially outwards, the ferrule is formed by a length of a single blade curved along an arc of a circle extending over a little more than 360° so that its two ends are partially overlapping, and shaped plates are added to the internal faces of these two ends so as to define respectively the two lateral slightly convergent cheeks of a gutter adapted to receive jointingly a flat trapezoidal key introduced therein in an axial direction, the two cheeks in question being directed so that said introduction of the key results in the urging of the ferrule to expansion and thus forcibly applying it against the inner surface of the tube end to be protected.

in a protection device according to at least the preceding paragraph, each plate is added to the ferrule by riveting-punching carried out from the outside to the inside of the ferrule so as to avoid the creation of any burrs or other projection on the outside of the ferrule, the innermost end of the ferrule is provided with a window adapted for allowing the radial passage of the lateral cheek of the gutter added at the other end of the ferrule, the axial dimension of this window being slightly greater than that of said cheek, but less than that of the key.

The invention comprises apart from these principal arrangements, certain other arrangements which are preferably used at the same time and which will be more explicitly discussed hereafter.

In what follows, there will be described a preferred embodiment of the invention with reference to the enclosed drawing in a manner which is of course in no way limiting.

Figure 2:
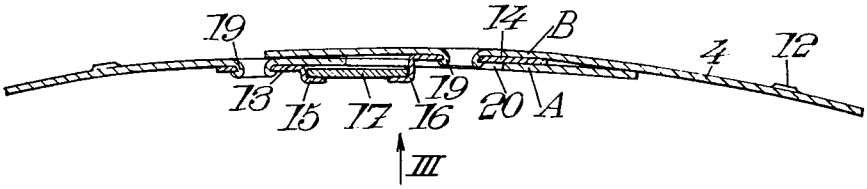
Figure 3:
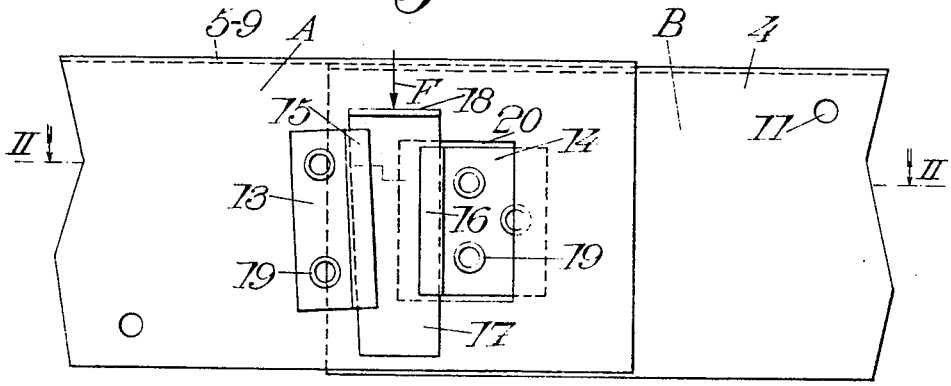

FIG. 1 of this drawing shows in partial axial section a tube end with chamfered edge protected by a device in accordance with the invention, FIGS. 2 and 3 show another portion, also constructed in accordance with the invention, of this same device, on a scale slightly more reduced than previously, respectively in axial section along II—II of FIG. 3 and in an inside view along arrow III of FIG. 2.

The tube end 1 considered forms part of a large diameter smooth tube, i.e. greater than 20 cm and relatively thick (thickness generally greater than 1 cm) meant to be welded end to end with other similar tubes for forming a fluid transport pipe (oil pipeline, gas pipeline . . . ).

This tube end has a chamfered end edge, i.e. machined in accordance with an inner flat annular transverse surface connected on the outside to a surface 3 in the shape of a truncated cone.

The radial dimension of the flat surface 2 is relatively small, e.g. of the order of a centimeter.

The semi-angle at the apex of surface 3 in the form of a truncated cone is generally between 45° and 60°, e.g. of the order of 55°.

It is especially surface 2 which must be protected from impacts.

It is in fact this surface which defines, with a similar surface disposed axially opposite thereto, at a small axial distance d, the gap of width d to be filled in by the first welding pass for sealingly joining these two surfaces: irregularities in said surfaces would risk causing sealing defects of the welding bead obtained, seeing that this latter is generally obtained by automatic methods not lending themselves very well to local corrections.

Now it is precisely said surface 2 which is at one and the same time the one which projects most at the end of the tube and is the most fragile because, radially, the least thick: it is thus the most sensitive to impacts.

To protect it, a mask is used formed, in accordance with the invention, by a thin metal strip curved according to a ferrule 4 itself having an edge doubly bent back 5,6.

The thickness of this strip is of the order of a millimeter, being more generally between 0.5 and 2.5 mm, preferably between 0.8 and 2 mm.

The diameter of the outer surface of the ferrule is practically equal to the diameter of the inner surface of tube 1, against which this ferrule is applied in the manner described herebelow.

The folded back edge of said ferrule, which is applied axially against surface 2 during fitting of the ferrule on to tube end 1, has successively a first section 5 turned radially back towards the outside and a second section 6 turned radially back towards the inside from the periphery of the first section 5.

The two turned back portions are executed in the same direction so that the second turned back section 6 is on the same side as the body of ferrule 4 in relation to the first turned back section 5; if the two folded back portions were executed respectively in two opposite directions, the edge of the ferrule not inside the protected tube end 1 would remain projecting from the double flap, which would present risks of catching tending to open this double flap; moreover such a solution would lend itself ill to the methods of manufacture about which some precise details will be given further on.

The second section or flap 6, bent from the first, is connected thereto by an annular zone 7 of a toric trend. Since the radius of this annulus cannot be zero, there exists a space 8 between the two flaps 5 and 6, at least at their maximum radii and the whole presents an elastic resistance to axial crushing, this resistance causing a complement of bending or flexion more or less marked at said toric connection zone.

Experience shows that this elastic resistance enables the impacts exerted locally on the double flap considered to be damped in an excellent fashion: the presence of this latter results in the pressure of these localised impacts to be, at one and the same time, distributed in space and spread out in time, so that these impacts no longer risk causing damage to the protected tube edge.

To complete this particularly favourable elastic resistance effect, a damping element 9 elastically resisting crushing can be introduced into space 8.

If the insertion of this element is effected when hot, it can be formed by an asbestos cord.

But said element can be formed in any other suitable way, e.g. by a seal made from rubber, elastomer or even from a plastic material such as polytetrafluoroethylene, or else by pieces of metal springs.

The radial dimension of the double flap 5,6 is provided sufficiently small so as to obviate any risk of tearing off the ferrule by outside elements arriving at this flap just after sliding against the outer cylindrical surface C of tube 1: said double flap is in practice located inside the extension of this cylindrical surface, which puts it out of reach of such outside elements. As can be seen in FIG. 1, it is advantageous for the double flap to cover the largest part of the edge formed of the two surfaces 2 and 3.

The manufacture of the double flap ferrule described above can be carried out in any desirable way, preferably by bending first of all the length of metal strip forming this ferrule into a cylindrical hoop, then by turning back the desired portions by snarling or hammering against an appropriate support or by passing it through a roller profiling machine; it is advantageous to begin with the second flap 6 and to finish with the first flap 5.

To reserve a gap 10 having a non zero radial thickness and sufficiently ventilated between ferrule 4 and tube end 1 inside which it is fixed, there is advantageously formed in this ferrule holes 11 from the outside towards the inside, so as to create on the outer surface of said ferrule collars or burrs 12 projecting sufficiently to ensure the desired spacing.

The presence of this gap removes the danger of a molecular type intimate contact between the ferrule and the tube, this contact being able to cause in the long run an adhesion making it difficult to remove the ferrule without damage at the desired time for welding.

This presence makes possible furthermore natural drainage by flowing or evaporation, in particular through holes 11, of rainwater, which might infiltrate into said gap and whose stagnation would risk causing troublesome oxidation.

There will now be described a preferred method for fitting the above described ferrule on the tube end considered.

This ferrule is formed from a length of a single strip bent along an arc slightly greater than 360° so that its two ends A and B partly overlap (FIGS. 2 and 3).

At these two ends there are inserted two plates 13 and 14 bent back in a right-angled Z.

These two plates define with the ferrule portions on which they are inserted U-shaped channels which are open towards each other in a circumferential direction and form respectively the two side cheeks 15 and 16 of a gutter adapted to receive jointingly a flat key 17.

The two cheeks 15 and 16 are slightly convergent towards one another in the direction of key introduction, i.e. in the direction of axial penetration towards the inside of the tube from its edge (arrow F in FIG. 3).

Key 17 has the general shape of a trapezoidal plate whose convergence is similar to that of cheeks 15 and 16.

For this reason the axial introduction of the key into the above-defined gutter causes the two cheeks 15 and 16 to move progressively apart and so the ferrule to xpand, which urges this latter with high pressure against the inner face opposite of tube end 1.

This axial introduction is facilitated by hammering a flange 18 bent at right-angles from plate 17.

To avoid any undesirable unevennesses on the outer surface of ferrule 4, the shaped plates 13 and 14 are advantageously added on the inner face of this ferrule by riveting-punching carried out from its outer face, the hollow rivets thus formed being shown by the reference 19 in FIGS. 2 and 3.

To permit a particularly firm and rigid mutual engagement of the two ends A and B of the ferrule one on the other, there is advantageously provided in one A of these ends a window 20 through which passes radially the gutter cheek 16 mounted on the other end B.

The axial dimension of this window 20 is only slighter greater than that of cheek 16, but is less than that of key 17.

Moreover, cheek 16 is dimensioned so that, depending on the radial thickness of the key, this latter has just radially sufficient room to penetrate jointingly between the free turned back edge of this cheek and the internal face A of the ferrule.

Consequently, during keying, a tight and very efficient radial imprisonment can be observed of ferrule end A between ferrule end B and key 17, which prevents any deformation of these ends.

Experience shows that the firmness of the assembly thus achieved of the ferrule 4 on tube end 1 is remarkable and very superior to that observed with previously known assemblies.

It is to be noted moreover that the assembly of the ferrule by keying is achieved very simply and rapidly.

Disassembly is just as simple and rapid, since it is sufficient for this purpose to free the key by exerting on its flange 18 an axial thrust or pull in the direction opposite arrow F, then to remove cheek 16 from window 14.

Said window 14 could be open on the side of the end edge of ferrule end A, but it is preferred that it is closed over the whole of its periphery so as to avoid the risks of accidental fouling which could be caused during storage or assembly by the two "fork teeth" lugs which would then define this window.

Following which and whatever the embodiment adopted there is finally provided a protection device whose constitution and use follow sufficiently from what has gone before.

This device presents numerous advantages in relation to those previously known, particularly the efficiency of the protection obtained, the lightness, which facilitates particularly its assembly and reduces its cost price, the firmness of its fitting on the tube end to be protected, the absence of any adhesion and oxidation between the assembled parts and the continuity of the protection obtained over the whole length of the edge to be protected, in the preferred case where the two ends of the arc of the ferrule mutually overlap.

As is evident and as it follows already moreover from what has gone before, the invention is in no wise limited to those of its embodiments and modes of application which have been more specially considered; it embraces, on the contrary, all variations thereof, particularly those where the edge of the ferrule is turned back in more than two successive annular folds, the axial semi-section of the multiple flap obtained being then able to have the form of a crushed spiral or that of a zig-zag line.

We claim:

1. A device for mechanically protecting from impacts the annular edge of a smooth tube end having a diameter greater than 20 cm, said device comprising:

a metal ferrule for mounting the tube end and having a first flap turned radially outwardly and back for covering the tube edge;

a second flap extending from the end of said first flap and turned back to extend radially towards the axis of said ferrule to be disposed between the tube end and said first flap; and said ferrule being formed by a length of a single blade bent in an arc of a circle, and including shaped plates attached to the internal faces of the two ends of said blade so as to define respectively the two lateral slightly convergent cheeks of a gutter for receiving a flat trapezoidal key introduced therein in the axial direction, said two cheeks being directed so that introduction of said key results in said ferrule being expanded and being forcibly applied against the inner surface of the tube end, and said circular arc extending slightly more than 360° so that said blade two ends overlap.

2. A device as recited in claim 1 wherein the outer diameter of first and second flaps is less than the outer diameter of the tube end to be protected.

3. A device as recited in claim 2 for protecting a tube end having a thickness greater than 1 cm. wherein the thickness of said ferrule is between about 0.5 and 2.5 mm.

4. A device as recited in claim 1 further comprising a shock absorbing element axially inserted between said first and second flaps.

5. A device as recited in claim 4 wherein said shock absorbing element is selected from the group consisting essentially of asbestos, elastomer, rubber, polytetrafluoreoethylene, and metallic spring material.

6. A device as recited in claim 1 wherein radially outward perforations are provided in said ferrule for providing a spacing between said ferrule and the inside of the tube.

7. A device as recited in claim 1 wherein each plate is attached to said ferrule by a rivet punch radially extending from the outside to the inside of said ferrule so that no burrs or other projections are formed on the outside of said ferrule thereby.

8. A device as recited in claims 1 or 7 wherein said ferrule has an innermost end with a window formed therein for allowing said lateral gutter cheek attached to said ferrule other end to pass therethrough, the axial dimension of said window being slightly greater than that of said cheek, but less than that of said key.

* * * * *